US005539369A

United States Patent [19]

Selker et al.

[11] Patent Number: 5,539,369

[45] Date of Patent: Jul. 23, 1996

[54] MULTIPLE-TOROID INDUCTION DEVICE

[75] Inventors: Edwin J. Selker, San Jose, Calif.; Jason M. Jacobs, Cambridge, Mass.; Robert J. Kelley, Scio, Oreg.; Joseph D. Rutledge, Mahopac, N.Y.

[73] Assignee: International Business Machines Corporation, Armonk, N.Y.

[21] Appl. No.: 314,614

[22] Filed: Sep. 28, 1994

Related U.S. Application Data

[63] Continuation of Ser. No. 4,338, Jan. 14, 1993, abandoned.

[51] Int. Cl.[6] ..... H01F 27/28

[52] U.S. Cl. ..... 336/212; 336/229; 336/178

[58] Field of Search ..... 336/212, 175, 336/229, 174, 178, 209; 29/606, 602.1

[56] References Cited

U.S. PATENT DOCUMENTS

| | | | |
|---|---|---|---|
| 2,314,912 | 3/1943 | Troy . | |
| 2,436,742 | 2/1948 | Bussey . | |
| 2,820,109 | 1/1958 | Dewitz . | |
| 3,327,253 | 6/1967 | Campbell . | |
| 3,423,710 | 1/1969 | Allen | 336/155 |
| 3,454,916 | 7/1969 | Hoover . | |
| 4,160,966 | 7/1979 | Kennedy | 336/155 |
| 4,484,171 | 11/1984 | McLoughlin | 336/84 R |
| 4,513,274 | 4/1985 | Halder | 336/173 |
| 4,519,015 | 5/1985 | Lin | 361/399 |
| 4,939,623 | 7/1990 | Equi et al. | 361/399 |

FOREIGN PATENT DOCUMENTS

| | | | |
|---|---|---|---|
| 1511775 | 9/1989 | U.S.S.R. | 336/229 |

*Primary Examiner*—Laura Thomas

*Attorney, Agent, or Firm*—Heslin & Rothenberg; Wayne F. Reinke

[57] ABSTRACT

An induction device has an elongated core made of two or more uniform ferromagnetic spaced-apart toroids. A first winding around the core creates an inductor. When the induction device includes a second winding, a transformer is created. The transformer acts as a powercord transformer when the exposed ends of one winding are available at one end of the elongated core for connection to a source of alternating current and the exposed ends of the other winding are available at the other end of the core for connection to a load. An inductor with a single-turn winding can be constructed by first forming the core by stacking two or more ferromagnetic toroids end-to-end and spaced apart, then threading two wires through the core center and placing two wires outside the core and connecting the ends of the wires to create the winding. A transformer can be constructed by first following the steps to create an inductor. A second winding is then created in a similar manner as the first winding.

17 Claims, 4 Drawing Sheets fig. 2b
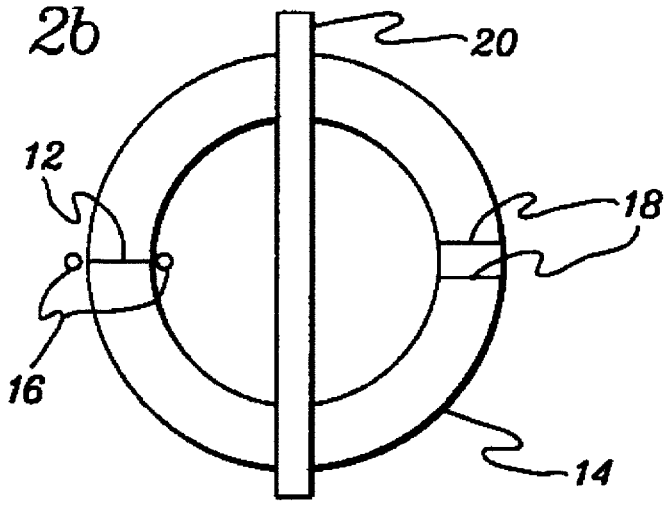
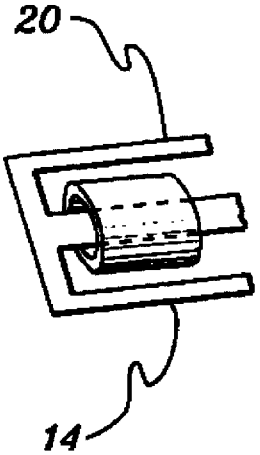
fig. 2c
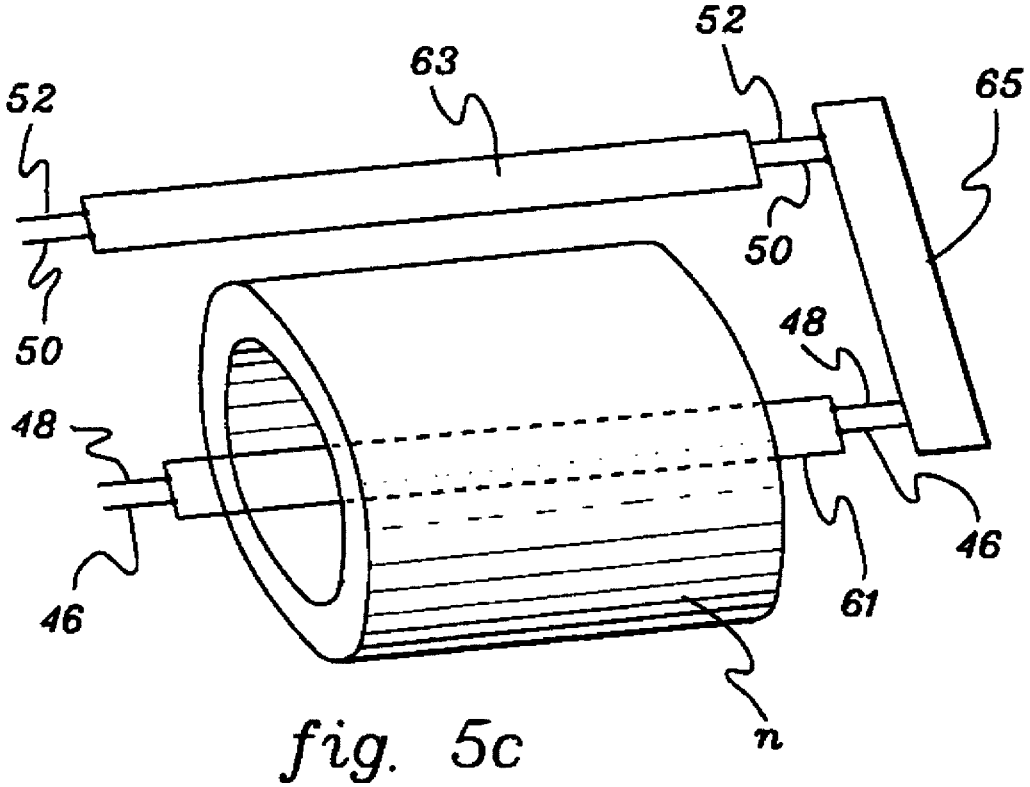
fig. 5c

MULTIPLE-TOROID INDUCTION DEVICE

This is a continuation of application Ser. No. 08/004,338, filed Jan. 14, 1994 now abandoned.

BACKGROUND OF THE INVENTION

1. Technical Field

The present invention relates generally to induction devices. More particularly, the present invention relates to inductors and transformers.

2. Background Art

Traditional design and manufacture of induction devices, such as inductors and transformers, includes winding wires about a single core. In the past, the core has taken several forms, including a large toroid, an e-shaped armature and a cup core. The induction device resulting from such a core is generally box- or toroid-shaped and is not flexible. Consequently, the size of such an induction device frequently dictates the size of any device it is a part of. This is especially true for small and/or portable devices.

Many electrical devices use a power supply with a portable transformer. A popular type of power supply transformer takes the form of a box which may have prongs that plug into a wall outlet, or which may have a cord extending to a wall outlet and another cord extending to the device.

Box-type transformers provide several advantages. Electrical noise is isolated outside the device, rather than including the entire power supply within the device. Potentially dangerous voltage is also isolated outside the device. In addition, heat from the power supply is isolated away from the device.

However, such transformers also have several disadvantages. With very large box transformers, the heat generated may require a system for cooling. Often, the cooling system utilizes chemical coolants, such as freon, to cool the transformers. Such chemical coolants may be potentially dangerous to the environment. In addition, cooling systems may add to the cost of the power supply and/or the device(s) it is associated with. With smaller box transformers, the major disadvantage is inconvenience. For a portable device, a box transformer can be cumbersome to transport. A smaller box transformer may also be forgotten, rendering the device useless. Also, plug-in box transformers often fall out of the outlet due to their own weight. In addition, the box-type plug-in transformers may cover up other outlets.

Another type of transformer potentially solves the problems associated with box-type transformers. Transformers shaped like appliance powercords are being re-examined. Powercord transformers do not suffer from the disadvantages associated with box-type transformers. Heat is dissipated along the length of the transformer, rather than being concentrated in one place. Assuming the powercord transformer is attached to a portable device, it cannot be forgotten in transport. As a conventional plug can be used with the powercord transformer, other outlets are not covered up. In addition, since a powercord transformer's weight is dispersed over its length, the possibility of the plug falling out of the outlet is greatly reduced.

In the prior art, cord-like transformers, hereinafter referred to as powercord transformers, are highly inefficient and may not work. One example of a powercord transformer is described in U.S. Pat. No. 2,436,742, issued to Bussey. Disclosed there is a combination transformer and powercord. However, the Bussey powercord transformer, referred to therein as a line cord transformer, fails to provide a reliable return path for the magnetic flux produced in the single core. Presumably, although not disclosed therein, Bussey utilizes air as a return flux path to induce a voltage in the secondary winding. Given that air has a permeability ($\mu$) of 1, it is a distinct possibility that no voltage or an insufficient voltage will be induced in the secondary winding.

In addition to the restrictions resulting from traditional induction device design, traditional methods of manufacture are inherently difficult to implement. Automation of the manufacturing process is often expensive and impractical, since traditional coil winding methods of manufacture require complex mechanical operations.

Thus, a need exists for a new induction device design, as well as a method of manufacture that is easily implemented.

DISCLOSURE OF THE INVENTION

Briefly, the present invention satisfies the need for a new induction device design and efficient method of manufacture by introducing an induction device comprising multiple toroids, as well as an efficient method of manufacture therefor.

In a first aspect of the present invention, an inductor is provided with an elongated toroidal core. The core comprises two or more ferromagnetic toroids that are stacked end-to-end. A winding is then toroidally wound around the stack of toroids.

In a second aspect, a multiple toroid transformer is provided. The transformer comprises the inductor of the first embodiment with a second winding toroidally wound around the toroid stack.

In a further aspect of the present invention, a method of manufacturing a multiple-toroid inductor is provided. A first ferromagnetic toroid having a first end and a second end, and a second ferromagnetic toroid also having a first end and a second end are stacked such that the second end of first toroid and the first end of the second toroid are adjacent and coaxial. A first electrically conductive wire and a second electrically conductive wire are threaded through the center of the toroid stack. The first and second wires each have a first end corresponding to the first end of the first toroid and a second end corresponding to the second end of the second toroid. A third electrically conductive wire and a fourth electrically conductive wire are placed outside the toroid stack in parallel to said first and second wires. The third and fourth wires each have a first end corresponding to the first end of the first toroid and a second end corresponding to the second end of the second toroid. The second end of the first wire is connected to the second end of the third wire. The first end of the second wire is connected to the first end of the third wire. The second end of the second wire is connected to the second end of the fourth wire. In this way, a single complete toroidal winding is produced.

This manufacturing aspect can be extended by similarly forming a second toroidal winding, to provide a method of manufacturing a multiple-toroid transformer.

These, and other objects, aspects, features and advantages of this invention will become apparent from the following detailed description of the presently preferred embodiments of the invention taken in conjunction with the accompanying drawings.

BRIEF DESCRIPTION OF THE DRAWINGS

FIG. 2*b* provides a front view of the transformer of FIG. 2*a* with a winding separator.

FIG. 2*c* provides a side view of part of the transformer of FIG. 2*b*.

FIG. 5*c* depicts the nth toroid of FIG. 5*b* with prefabricated wire bundles and a single connection device to connect the wires.

BEST MODE FOR CARRYING OUT THE INVENTION

The present invention introduces an induction device design that replaces conventional inductors, box-type transformers and single toroidal transformers. The new design could, for example, be implemented as a powercord transformer for many devices, such as portable computers, shavers and modems. In addition, the new design lends itself to a novel and efficient method of manufacture.

Figure 1:
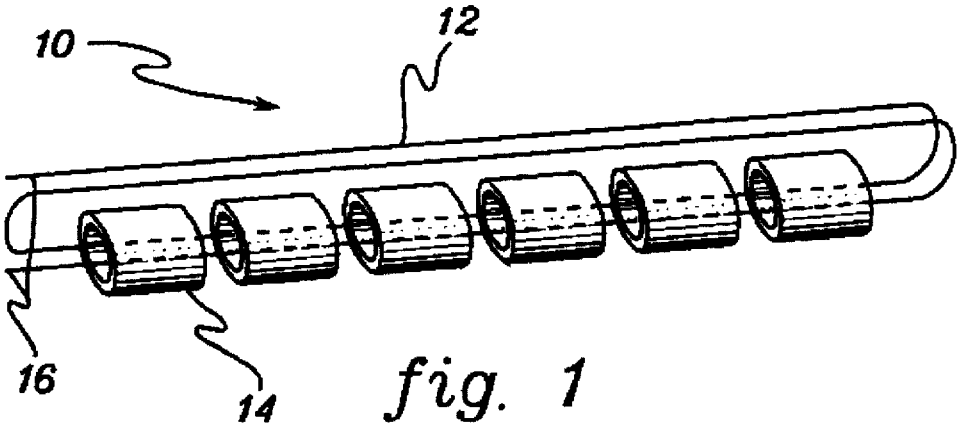
FIG. 1 depicts a multiple-toroid inductor constructed according to the teachings of the present invention.

In a first aspect of the invention, a multiple-toroid inductor is introduced. FIG. 1 depicts such an inductor 10 with a single toroidal winding 12. As can be seen in FIG. 1, a single toroidal winding is a wire threaded through the center of a toroid core, around an end of and alongside the core, back through the center again and alongside the core to the end where the winding began. The inductor core comprises a number of individual toroids 14 stacked in line, or end to end, as shown in FIG. 1. Preferably, all the toroids are of uniform dimensions. As is known in the art, an alternating current flows through winding 12 creating a magnetic flux through the circumference of each toroid. The use of a core in the shape of a toroid, as is known in the art, provides a complete flux path and ensures that flux leakage is kept to a minimum. In effect, the inductor 10 comprises multiple individual inductors with overall properties, such as inductance and energy storage, equal to the sum of the properties of the individual inductors.

Each toroid comprises ferromagnetic material. Preferably, all toroids in the core are made of the same ferromagnetic material. While the preferred material is PERMALLOY, a high permeability alloy of iron and nickel, other ferromagnetic materials may be used, such as iron alone or silicon steel.

Figure 2A:
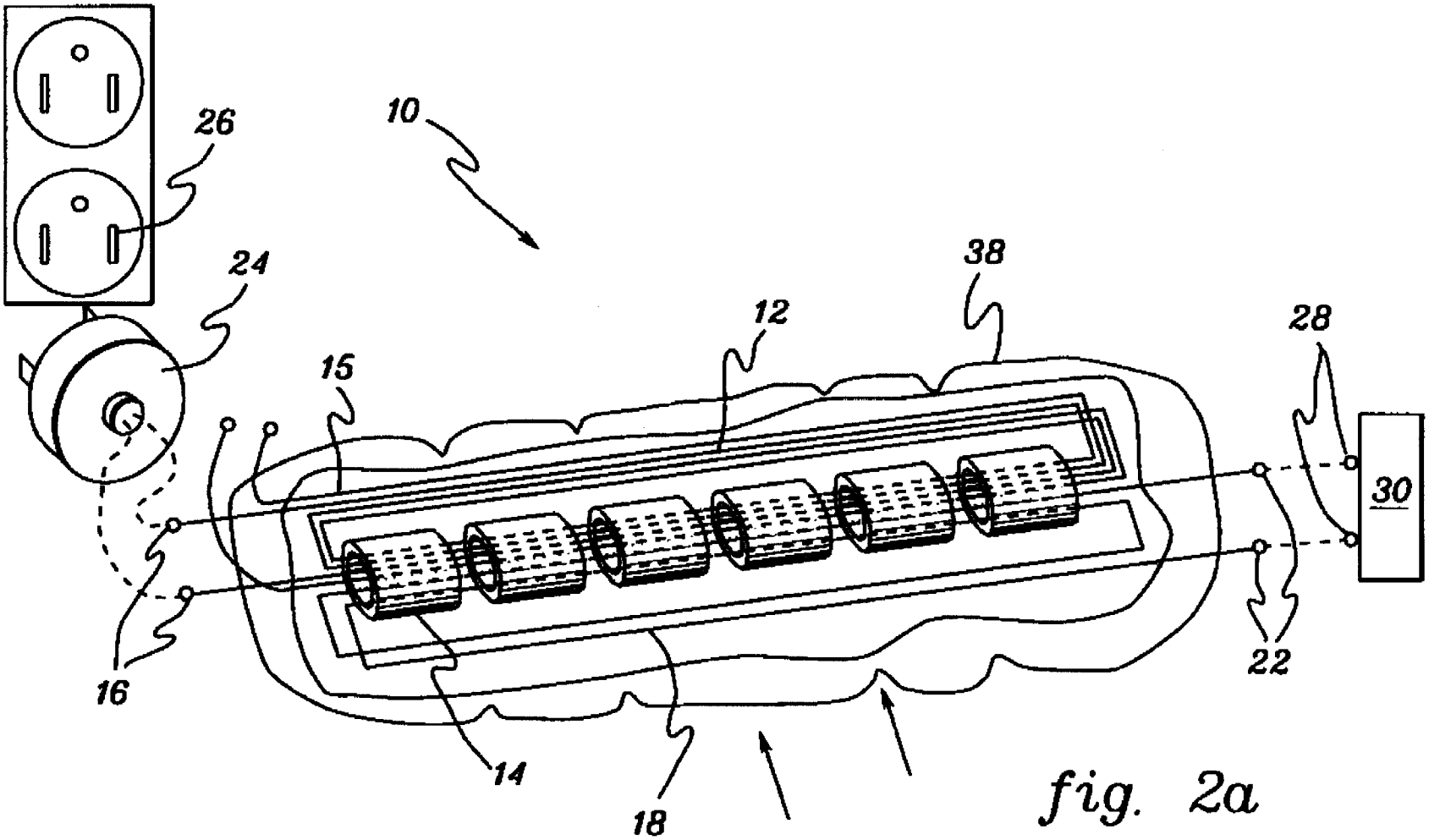
FIG. 2*a* depicts a multiple-toroid transformer constructed according to the teachings of the present invention.

In a second aspect of the invention, a multiple-toroid transformer is presented. Such a transformer comprises the inductor 10 of FIG. 1 along with a second winding 18. The second winding could be identical to winding 12 or be wound the opposite way, as shown in FIG. 2*a*. One winding acts as a primary and the other winding acts as a secondary. Optionally, windings 12 and 18 are separated for safety by a separator. Such a separator could be, for example, a piece of cardboard 20 through the core center and alongside the core as shown in FIGS. 2*b* and 2*c*. Each winding could then be wound around half the core on either side of the cardboard.

Like other transformers, the transformer of the present invention may be a step-up transformer or a step-down transformer. As is known in the art, one need only alter the turns ratio (the number of primary winding turns over secondary winding turns) to achieve the desired transformer output. It will be understood that the transformer of the present invention may have an output voltage identical to the input. Such is the case when the transformer is used for isolation; that is, to protect the power source from, for example, lightning.

When a transformer of the second aspect is used as a powercord transformer, the exposed ends 22 of winding 18 are preferably at the other end of the transformer with respect to the exposed ends 16 of winding 12. This allows for one winding to be connected to a source of alternating current and the exposed ends of the second winding to provide an alternating voltage at the other end of the transformer to a load, such as an electrical device. For example, winding 12 could be connected to a standard plug 24 for access to wall outlet 26 as a source of alternating current, and winding 18 could be connected to the terminals 28 of load 30.

A third "(see winding 10 in FIG. 2*a*)" or more windings, identical to either winding 12 or 18, may also be included in a multiple toroid transformer of the present invention. The additional windings could be used for sensing flux in the core, in order to control operation of the transformer. For example, some power supplies control the frequency of the power supplied to the transformer so that the transformer can be run at its limit.

The induction device of the present invention in the form of a transformer may achieve a variable output where one or more taps are placed on the secondary winding. As is known in the art, a transformer tap is a connection to a winding in an area other than the actual winding ends and effectively achieves a different turns ratio, thus changing the output of the transformer.

The novel induction device of the present invention has inherent physical flexibility when the toroids are, preferably, spaced apart. This flexibility is especially important when implementing the second aspect as a powercord transformer. The space between each individual toroid provides a segmented structure with inherent flexibility and helps prevent damage to any individual toroid. Although flexibility is gained from toroid spacing, efficiency may decrease slightly due to increased winding resistance. However, increased winding resistance in the primary winding does provide a measure of power surge protection. Thus, depending on the particular implementation, there is a trade-off between efficiency and the combination of transformer flexibility and power surge protection.

Figure 3:
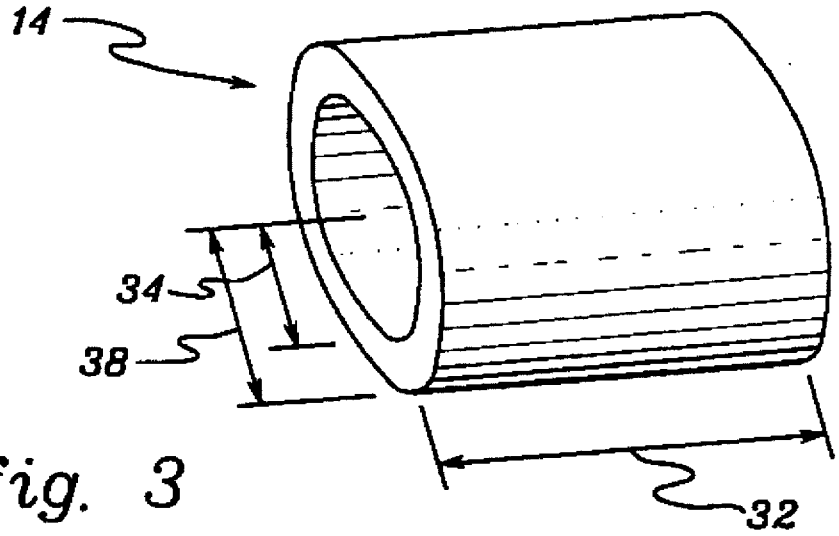
FIG. 3 depicts a single toroid from the inductor of FIG. 1.

The number of toroids included in a given transformer depends on the material comprising the toroids, the toroid geometry and the input voltage and operating frequency for which the transformer is designed. FIG. 3 is an exploded view of toroid 14 in FIG. 1. Toroid 14 has a length 32, an inner radius 34 and an outer radius 36. The inductance of the inductor or the primary winding of the transformer (winding 12 in FIG. 1) can be found by the equation:

$$L=(2\times10^{-7})\mu N^2 nl\ln(b/a).$$

In the preceding equation, L represents inductance and has the units henries. The permeability of the toroid core 14 material is μ and is unitless. N is the number of turns in the inductor or the primary winding (winding 12 in FIG. 1). The number of individual toroids is given by n. The length 32 of each toroid in centimeters is given by 1. The inner radius 34, a, of each toroid is given in centimeters. The outer radius 36, b, of each toroid is also given in centimeters. The maximum tolerable input RMS sinusoidal voltage per turn before saturation of the inductor or primary winding is given by the equation:

$$V/N=(7.07\times10^{-7})H_m\omega\mu nla\ln(b/a).$$

V is RMS voltage given in volts. $H_m$ is the magnetizing force required to saturate the toroid material in units of oersteds. The angular frequency at which the inductor/transformer is operated is given by ω in units of radians per second, equal to 2πf where f is frequency. From these equations, one skilled in the art can appreciate that the number of toroids required for a given ferromagnetic material and toroid geometry is determined by the operating frequency and input voltage for which the inductor/transformer is designed.

As an example, a multiple-toroid transformer prototype was constructed with 60 primary winding turns, 6 secondary winding turns and 44 uniform toroids spaced about 0.3125 cm apart. Each toroid had a length of approximately 1.25 cm, an inner radius of about 0.625 cm and an outer radius of about 0.94 cm. The transformer was operated at a frequency of 1000 hertz and a corresponding voltage of 120 volts. The maximum inductance for the prototype was about 0.13 henries. Each toroid was made of PERMALLOY comprising 50% iron and 50% nickel, having a permeability of about 200,000 and a saturation magnetizing force of about 0.188 oersteds. Each toroid was tape wound using a 13.75 inch strip of PERMALLOY tape 0.02 inches thick and 0.5 inches wide. As is known in the art, a tape wound toroidal core reduces unwanted eddy currents compared to a solid toroidal core.

Optionally, the inductor of the first embodiment and the transformer of the second embodiment have a protective outer layer 38 as shown in FIG. 2*a*. The outer layer may be electrically insulating, such as rubber or fabric. The outer layer may also be thermally conductive to facilitate cooling. The protective layer may also be formed such that any bending of the transformer is encouraged to be in the area between toroids, rather than the area surrounding a given toroid. Bending between toroids may be encouraged by, for example, making the protective layer thicker or stiffer around each toroid compared with between toroids.

Figure 4:
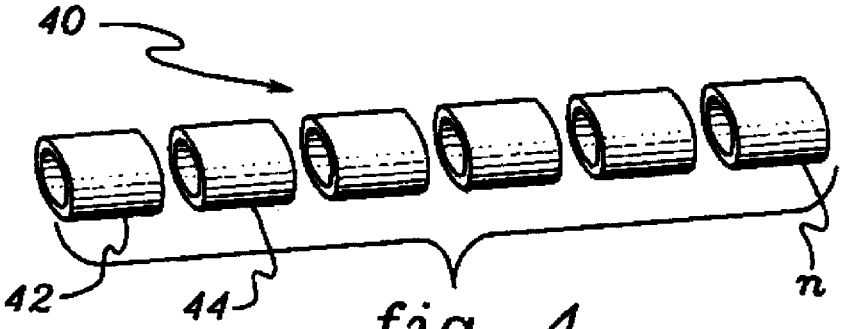
FIG. 4 depicts a stack of spaced-apart toroids.

The induction device of the present invention lends itself to a novel method of manufacture which will now be described. FIG. 4 depicts a stack 40 of toroids (e.g., 42, 44, . . . , n) that are spaced apart and placed end to end. Stack 40 creates a long, hollow, tube-like structure. It will be understood that any number of individual toroids can be stacked to create an induction device according to the present invention.

Figure 5A:
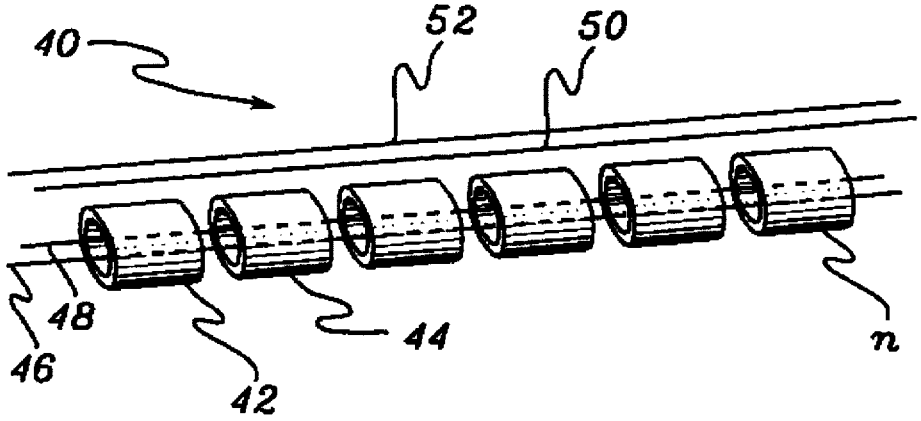
FIG. 5*a* depicts the toroid stack of FIG. 3 with two wires threaded through the center of the stack and two wires placed outside and alongside the stack.

FIG. 5*a* depicts the toroid stack 40 of FIG. 4 with wires 46, 48, 50 and 52. Wires 46 and 48 are threaded through the center of toroid stack 40. Wires 50 and 52 are placed outside and alongside toroid stack 40.

Figure 5B:
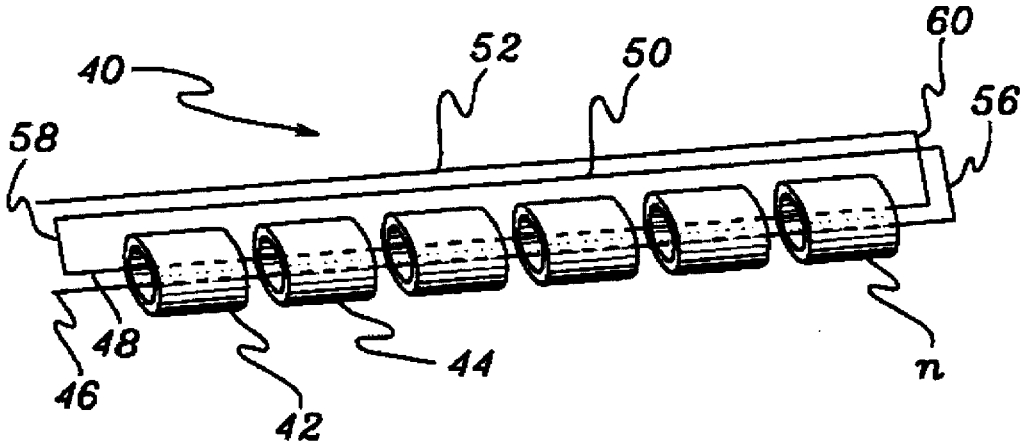
FIG. 5*b* presents the toroid stack and wires of FIG. 5*a* after connecting the wires in accordance with a manufacturing aspect of the present invention.

FIG. 5*b* depicts the toroid stack 40 of FIG. 5*a* after wires 46, 48, 50 and 52 have been connected to create winding 54. The connections include connecting wires 46 and 50 at connection 56, connecting wires 48 and 50 at connection 58 and connecting wires 48 and 52 at connection 60. The connections could be made, for example, by connecting a separate wire segment between wires or simply soldering the wires together. In this way, the winding 12 of inductor 10 in FIG. 1 can be created without using the cumbersome traditional toroidal winding method.

The wires placed in the center of the stack could be in a prefabricated bundle 61 with each wire being a certain distance from the next, as shown in FIG. 5*c*. If the wires placed outside the stack were also in such a prefabricated bundle 63, a single connection device 65 could be used to make the wire connections at either end of the transformer. The wire bundles could, for example, snap into such a connection device or be soldered thereto.

Figure 5D:
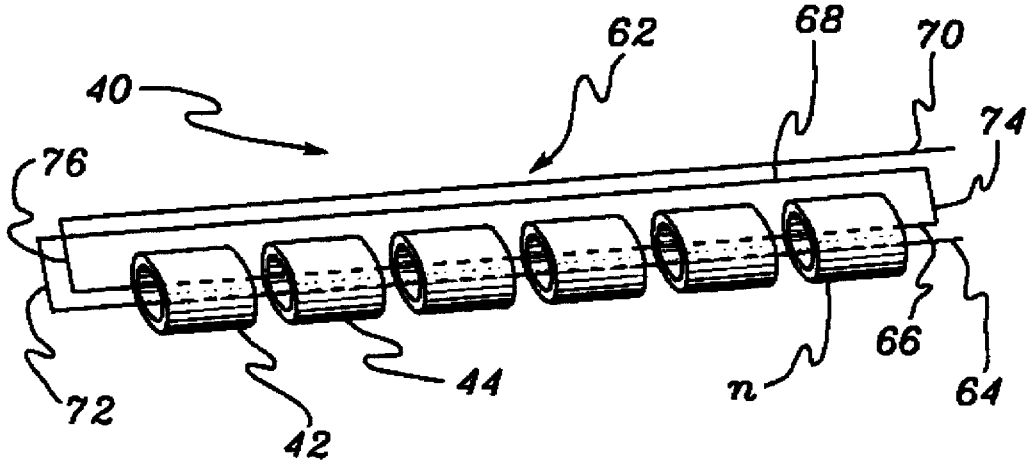
FIG. 5*d* presents the toroid stack and wires of FIG. 5*a* after connecting the wires to create a winding wound opposite that in FIG. 5*b*.

FIG. 5*d* depicts the toroid stack 40 of FIG. 5*a* with a second winding 62 created according to the method of the present invention. Creation of winding 62 entails threading wires 64 and 66 through the center of toroid stack 40 and placing wires 68 and 70 outside and alongside toroid stack 40. Wires 64 and 68 are then connected at connection 72, wires 66 and 68 are connected at connection 74 and wires 66 and 70 are connected at connection 76.

A multiple toroid transformer as shown in FIG. 2*a*, is formed when a primary winding 12 and a secondary winding 18 are wound about the same core. The transformer of FIG. 2*a* may now be used as a powercord transformer. Preferably, the transformer includes a protective layer 38 that is electrically insulating and thermally conductive. The exposed ends, 16 or 22 of one winding, 12 or 18, respectively, may be connected to a source of alternating current and the exposed ends of the other winding may be connected to a load.

While presently preferred embodiments of the invention have been described and depicted herein, alternative embodiments may be effected by those skilled in the art to accomplish the same objectives. Accordingly, it is intended by the appended claims to cover all such alternative embodiments as fall within the true spirit and scope of the invention.

We claim:

1. An induction device comprising:

an elongated toroidal core, said core comprising at least two unitary toroids stacked end-to-end, said at least two unitary toroids being spaced apart from one another, each of said at least two unitary toroids comprising ferromagnetic material;

a first winding toroidally wound around said core; and a second winding toroidally wound around said core.

2. The induction device of claim 1 wherein said at least two toroids are of uniform dimensions.

3. The induction device of claim 1 further comprising means for connecting said winding to a source of alternating current.

4. The induction device of claim 1 wherein exposed ends of said first winding are available at a first end of said induction device and exposed ends of said second winding are available at a second end of said induction device.

5. The induction device of claim 4 wherein said first winding is a primary winding and said second winding is a secondary winding.

6. The induction device of claim 5 further comprising:

means at said first end for connecting said exposed ends of said primary winding to a source of alternating current; and means at said second end for connecting said exposed ends of said secondary winding to a load.

7. The induction device of claim 6 wherein said induction device is a powercord transformer.

8. The induction device of claim 1 wherein said ferromagnetic material comprises an alloy of iron and nickel.

9. The induction device of claim 1 wherein said induction device is a step-down transformer.

10. The induction device of claim 1 wherein said induction device is a step-up transformer.

11. The induction device of claim 1 further comprising a third winding toroidally wound around said core for sensing flux in said core.

12. An induction device comprising:

an elongated toroidal core, said core comprising at least two unitary toroids stacked end-to-end, said at least two unitary toroids being spaced apart from one another, each of said at least two unitary toroids comprising ferromagnetic material;

a first winding toroidally wound around said core; and a protective outer layer, said outer layer being electrically insulating and thermally conductive.

13. An induction device comprising:

an elongated toroidal core, said core comprising at least two unitary toroids stacked end-to-end, said at least two unitary toroids being spaced apart from one another, each of said at least two unitary toroids comprising ferromagnetic material; and a first winding toroidally wound around said core, wherein said induction device is flexible.

14. A flexible induction device, comprising:

an elongated toroidal core, said core comprising at least two toroids stacked end-to-end, said at least two toroids being spaced apart from one another, each of said at least two toroids comprising ferromagnetic material;

a first winding toroidally wound around said core; and an outer layer for encouraging any bending of said induction device in an area between said at least two toroids and for discouraging bending in an area around each said at least two toroids.

15. The induction device of claim 14 wherein said outer layer is thicker in said area around each said at least two toroids compared with said area between said at least two toroids.

16. An induction device comprising:

an elongated toroidal core, said core comprising at least two unitary toroids stacked end-to-end, said at least two unitary toroids being spaced apart from one another, each of said at least two unitary toroids comprising ferromagnetic material;

a first winding toroidally wound around said core;

a second winding toroidally wound around said core; and insulating means for separating said first winding and said second winding.

17. An induction device comprising:

an elongated toroidal core, said core comprising at least two unitary toroids stacked end-to-end, said at least two unitary toroids being spaced apart from one another, each of said at least two unitary toroids comprising ferromagnetic material;

a first winding toroidally wound around said core;

a second winding toroidally wound around said core; and a protective outer layer, said outer layer being electrically insulating and thermally conductive.

* * * * *

UNITED STATES PATENT AND TRADEMARK OFFICE

CERTIFICATE OF CORRECTION

PATENT NO. : 5,539,369

DATED : July 23, 1996

INVENTOR(S) : Selker et al

It is certified that error appears in the above-indentified patent and that said Letters Patent is hereby corrected as shown below:

Column 4

Line 25, substitute –10– for "15".

Signed and Sealed this

Tenth Day of December, 1996

Bruce Lehman

*Attest:*

BRUCE LEHMAN

*Attesting Officer*

*Commissioner of Patents and Trademarks*